United States Patent [19]

Petersen et al.

[11] 4,132,236

[45] Jan. 2, 1979

[54] TILTABLE COLLAPSIBLE UMBRELLA AND TABLE COMBINATION

[76] Inventors: William Petersen; Mary A. Petersen, both of 30209 Cheret Pl., Palos Verdes, Calif. 90274

[21] Appl. No.: 815,151

[22] Filed: Oct. 31, 1977

[51] Int. Cl.[2] ..... A45B 17/00; A47B 37/04

[52] U.S. Cl. ..... 135/16; 135/20 M; 403/90

[58] Field of Search ..... 135/16, 20 M; 297/184; 108/50; 403/77, 90, 122

[56] References Cited

U.S. PATENT DOCUMENTS

| | | | |
|---|---|---|---|
| 338,986 | 3/1886 | Leistner | 135/20 M |
| 1,220,215 | 3/1917 | Gauss | 135/20 M |
| 1,996,071 | 4/1935 | Kahn | 135/20 R |
| 2,183,833 | 12/1939 | Farhar | 135/20 M |
| 2,190,498 | 2/1940 | Williams | 108/50 X |
| 3,145,720 | 8/1964 | Torii | 135/20 M |
| 3,935,874 | 2/1976 | Cohen | 135/16 |

*Primary Examiner*—Price C. Faw, Jr.
*Assistant Examiner*—Conrad L. Berman
*Attorney, Agent, or Firm*—Don B. Finkelstein

[57] ABSTRACT

In combination a tiltable collapsible umbrella and a table, the umbrella collapsible into a storage member underneath the center of the table.

2 Claims, 7 Drawing Figures

TILTABLE COLLAPSIBLE UMBRELLA AND TABLE COMBINATION

BACKGROUND OF THE INVENTION

1. Field of the Invention

This invention relates to an improved collapsible umbrella and table combination.

2. Description of the Prior Art

Collapsible umbrellas, also known as telescoping umbrellas are known, so is the tilt feature of the open umbrella. For example, U.S. Pat. Nos. 2,784,726 and 3,935,874 disclose typical collapsible umbrellas known to the art, while U.S. Pat. No. 2,743,146 discloses a typical tilting umbrella. None of the foregoing, however, disclose the present invention combination of an umbrella collapsible within a table and an improved tilting feature as well to the umbrella.

SUMMARY OF THE INVENTION

It is, therefore, among one of the principal objectives of the invention to provide just such an improved collapsible umbrella and table as just mentioned.

In accord with the invention, there is now provided a tiltable collapsible umbrella in combination with a table, with removable coverable-storage means for the collapsed umbrella underneath the center of the table.

BRIEF DESCRIPTION OF THE DRAWING

The invention will be hereinafter more fully described with reference to the accompanying drawing in which:

FIG. 1(*a*) is a top plan view of the table with removable cover.

DESCRIPTION OF THE PREFERRED EMBODIMENTS

Figure 1:
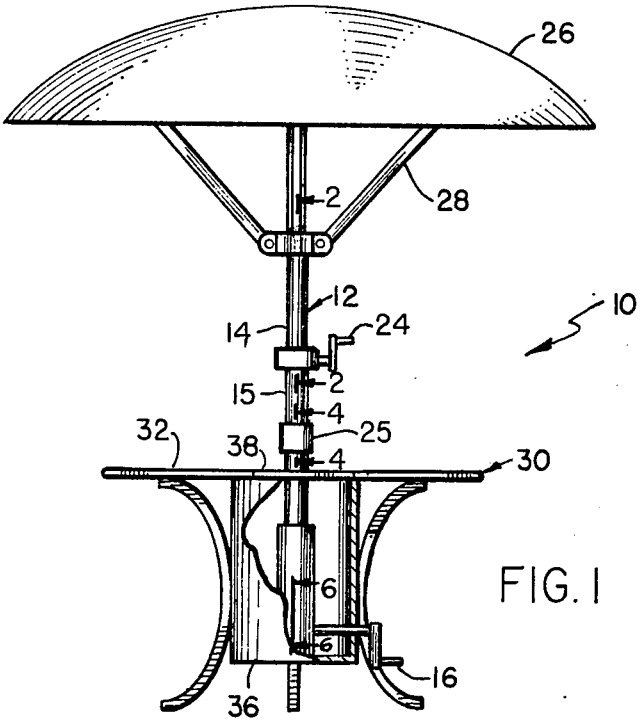
FIG. 1 is a plan elevated view of the inventive collapsible umbrella and table combination with a portion of the umbrella receiving member cut away.

Referring now to the figures of the drawing, there is shown therein the inventive combination tiltable collapsible umbrella and table 10 (hereinafter referred to as "combination"). The umbrella 12 comprises a main telescopic solid shaft 14 operated by a bottom crank 16 which turns a gear wheel 18 whose gear teeth 20 are meshable with recesses 22 in the bottom of the shaft 14. This telescoping feature is conceded as conventional and need not be further described. Similarly conventional is the upper crank 24 which turns gear wheel 18' whose gear teeth 20' mesh with recesses 22' in the upper portion of the shaft. Thus, bottom crank 16 raises and lowers the shaft 14 while upper crank 24 opens and closes the umbrella cover portion 26 by expanding and collapsing the ribs 28 (which latter feature is too conventional).

The table 30 portion of the combination is any standard circular or 4-sided table, in this instance circular. The table top 32 has a central circular opening 34 and a cylindrical open cannister 36 is in registry with this opening. The entire umbrella when collapsed fits inside this cannister. A removable circular cover 38 in two semi-circular parts is adapted to cover the opening with its own central opening 40 capable of accommodating shaft 14 when the umbrella is open. A solid cover can also be used when the umbrella is not in use.

Figure 4:
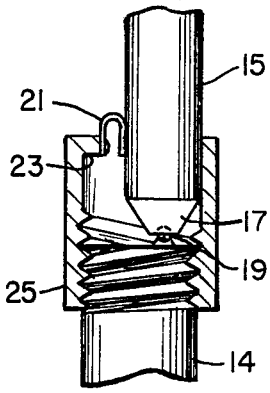
FIG. 4 is a sectional view taken along line 4—4 of FIG. 1.
Figure 5:
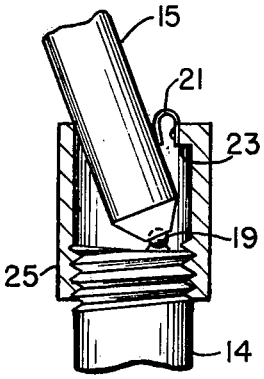
FIG. 5 is a view similar to FIG. 4 except that the tilting feature of the umbrella is shown.
Figure 2:
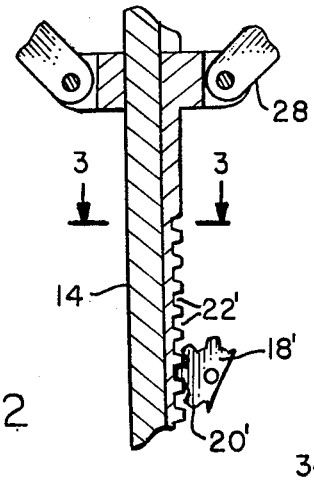
FIG. 2 is a sectional view taken along line 2—2 of FIG. 1.
Figure 3:
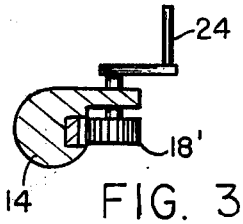
FIG. 3 is a sectional view taken along line 3—3 of FIG. 2.
Figure 6:
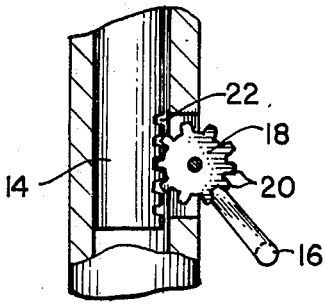
FIG. 6 is a sectional view taken along line 6—6 of FIG. 1.
Figure 1A:
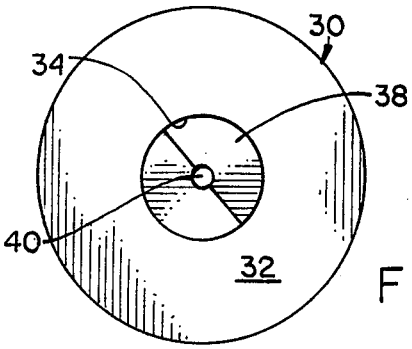

The improved tilting feature of the umbrella is shown in FIGS. 4 and 5. This is achieved by providing a separate upper shaft 15 whose lower end 17 terminates in a ball joint 19. This allows shaft 15 to be tilted about this ball joint 19. Shaft 15, whether tilted or upright, is urgingly held in place by a strong leaf spring 21. Leaf spring 21 is in inverted U-shape with one leg of the U mounted to a lip 23 on the upper rim of the collar 25. No crank for this tilt feature is necessary, simple manual power will tilt the upper shaft 15 or right it.

Thus, there is provided by the invention a combination of an umbrella collapsible within a table and an improved tilting feature.

What is claimed is:

1. In combination a collapsible umbrella and a table, said umbrella including a telescopic shaft and an openably closable umbrella cover, cranking means for telescoping said shaft and opening and closing said umbrella cover, said table having a central circular opening provided in the table top, a cylindrical open cannister registrable with said opening, said cranking means extending outside of said cannister, the entire umbrella and shaft fittable inside said cannister when collapsed, a removable circular cover providable for said opening, and said cover is in two semi-circular parts, said parts in turn defining a central opening for accommodation of said telescopic shaft when said umbrella is in the extended telescopic position; and said shaft is in two parts, an upper part and a lower part—the lower end of said upper part terminating mergedly into a ball joint for tiltingly moving said upper part with respect to the upper end of said lower part, said lower end of said upper part loosely housed in a collar which threadingly engages the upper end of said lower part, said lower end of said upper part being springingly urgingly held stationarily in place whether tilted or upright.

2. The combination according to claim 1 wherein a leaf spring holds said lower end of said upper part, said leaf spring secured to the inside upper rim of said collar.

* * * * *